United States Patent [19]

Boone

[11] 4,106,616

[45] Aug. 15, 1978

[54] DEVICE FOR POSITIONING A CONTAINER OF SUPPLEMENTAL MATERIAL IN OPERATIONAL ALIGNMENT ADJACENT TO A TOILET-TISSUE HOLDER

[76] Inventor: Philip Boone, 15 Fenwick Rd., Winchester, Mass. 01890

[21] Appl. No.: 779,136

[22] Filed: Mar. 18, 1977

[51] Int. Cl.[2] ..... B65D 69/00

[52] U.S. Cl. ..... 206/233; 206/494; 242/55.53; 248/215; 248/340

[58] Field of Search ..... 248/214, 215, 222.4, 248/340; 242/55.3, 55.53, 55.55; 206/494, 216, 225, 233, 390, 812

[56] References Cited

U.S. PATENT DOCUMENTS

| | | | |
|---|---|---|---|
| 2,141,314 | 12/1938 | Pfleger et al. | 242/55.55 |
| 2,685,365 | 8/1954 | Sieven | 242/55.53 |
| 2,790,608 | 4/1957 | Sieven | 242/55.3 |
| 3,151,822 | 10/1964 | Glaner | 242/55.55 |
| 3,271,090 | 9/1966 | Smithers | 242/55.53 |
| 3,316,040 | 4/1967 | McGann | 242/55.53 |
| 3,473,749 | 10/1969 | Rogers | 242/55.53 |
| 3,584,817 | 6/1971 | Schanaman | 242/55.53 |
| 3,837,595 | 9/1974 | Boone | 242/55.3 |

*Primary Examiner*—William Price
*Assistant Examiner*—Bruce H. Bernstein

[57] ABSTRACT

A device readily attachable to a standard toilet-tissue dispenser of a roll type for positioning adjacent thereto in visual alignment supplemental material such as a container of prewetted toilet sheets. The sheets are manually withdrawable from an aperture which is held firmly at a fixed position to assure their ready withdrawal and consistent location.

17 Claims, 9 Drawing Figures

DEVICE FOR POSITIONING A CONTAINER OF SUPPLEMENTAL MATERIAL IN OPERATIONAL ALIGNMENT ADJACENT TO A TOILET-TISSUE HOLDER

BRIEF SUMMARY OF THE INVENTION

The subject invention broadly relates to a device for meeting the inadequacy of present-day toilet-tissue alone to perform a thorough cleansing function. It implies the need of using a wetted sheet at the conclusion of the usual bathroom ritual by making it available directly at the conventional toilet-tissue dispenser.

At the present time there is believed to be but one product of a related category on the market and it is lacking in both function and appearance. The referenced item is so mounted by a strap portion as to dangle loosely from the spindle of a toilet-tissue holder as to prevent a bizarre appearance and to make its operation, that is removal of wetted sheets while thus suspended, uncertain and difficult. The uncontrolled angular suspension is very detrimental to the desired effect of making the dispenser of prewetted sheets an integral part of a complete unit which also embodies the standard toilet-tissue dispenser. Furthermore, the referenced item is deficient in that it makes cumbersome the replacing of an exhausted roll of toilet-tissue or an exhausted supply of prewetted sheets as the two procedures can not be performed independently of one another.

In the light of the foregoing deficiencies of the product now on the market, the present invention is believed to possess marked advantages as follows. It permits mounting of a container of pre-wetted sheets firmly and in visually pleasing alignment with the toilet-tissue roll-holder. It places the aperture for withdrawal of the sheets consistently at a fixed position. It permits changing the roll of toilet-tissue independently of the container of wetted sheets. It permits mounting a new container of wetted sheets independently of the roll of toilet-tissue. Other advantages will appear hereinafter.

In view of the foregoing considerations, objects of the invention are to provide an improved device for making available adjacent to a standard toilet-tissue holder a body cleansing or treating material; to provide a device of the character described which has appearance advantages of design and alignment consistent with a well-ordered bathroom; to provide a device of the type set forth which permits complete flexibility in replenishing exhausted supplies of the aforesaid material or toilet-tissue, that is one independently of the other; and to provide a device as characterized which is of simple construction and can be produced inexpensively. Other objects of the invention will in part be obvious and will in part appear hereinafter.

BRIEF DESCRIPTION OF THE DRAWING

The novel features which are believed to be characteristic of the invention are set forth with particularity in the appended claims. The invention, however, both as to its organization and its method of operation will best be understood from the following description when read in connection with the accompanying drawing wherein like numbers have been employed in the different figures to denote the same parts and wherein:

FIG. 6*a* illustrates the inner face of either component;

DETAILED DESCRIPTION

Figure 1:
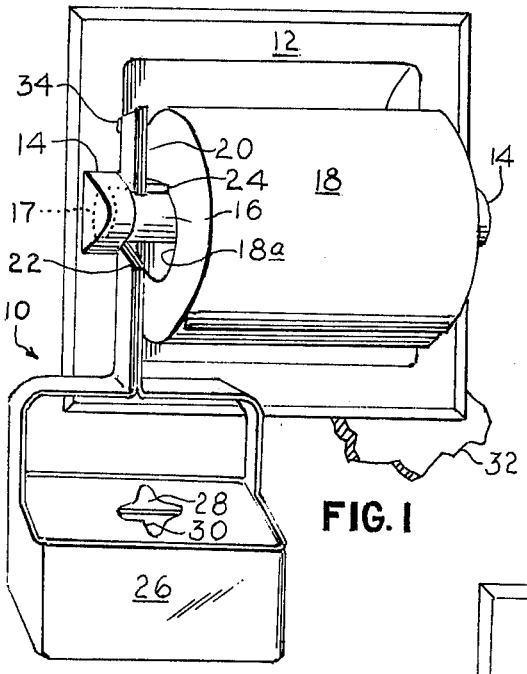
FIG. 1 is a diagrammatic perspective view of the wetted-sheet supply and positioning device of the invention including unitary arm and container means releasably attached to the spindle of a standard toilet-tissue dispenser (or roll-holder) by slotted means of the arm.

In FIG. 1 there is shown one form of the prewetted sheet supply and positioning device 10 of the invention mounted on a conventional toilet-tissue dispenser (roll-holder) 12. The roll-holder may, appropriately, be formed of a metal and include a pair of forwardly projecting posts 14 and a telescoping spring-biased retractable spindle 16 bearing a roll of toilet-tissue 18. The tips of the spindle are mounted in bores conventionally formed in the posts 14.

Figure 3:
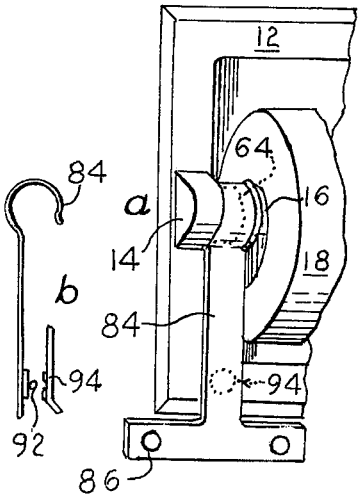
FIG. 3 is a fragmentary elevation view of a portion of the arm member of FIGS. 1 and 2.
Figure 3:
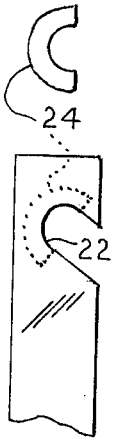

More specifically, the positioning means of the device comprises an arm member 20 having an angularly slotted portion 22 formed therein and preferably integral spacer means 24 shown in greater detail in FIG. 3. The inner slot portions are adapted to bear upon the spindle 16. As illustrated, the container 26, with cover removed, releasably carries a plurality of prewetted sheets 28 individually withdrawable through the aperture 30. The container is represented as unitary with the arm member 20 but could be a separate element attached to the arm member, for example, by snap-fasteners or otherwise fastened thereto, as suggested below.

The container 26 and arm member 20, as well as other forms of the device described below, may suitably be formed of a plastic composition such, for example, as polypropylene or ABS. The composition and dimensions of the arm member are preferably so chosen as to provide a considerable rigidity thereof and facilitate a fixed position of all components. A certain flexibility of the arm member is permissible if supplemental container anchoring means are employed, as described. The arm member and container may, alternatively, be composed of a metal. The arm member 20 is held firmly in a lateral direction against post 14 by spacer element 24 which, suitably, may be formed of a plastic material of low frictional property when in contact with the roll core so that it can be rotated easily for removal of the toilet-tissue.

The mutually joined arm member 20 and container 26 are easily released from engagement with the paper holder 12 by lifting manually the slotted arm portion 22 upwardly and rearwardly from contact with the spindle 16. Thus the supply of wetted sheets can be replaced instantly and independently of the roll of toilet-tissue. The attachment of arm 20 to the spindle 16, taken with the somewhat forward position of container 26 involves a center of gravity such that the latter is biased rearwardly against the wall 32 and thus derives considerable support. This position may be fixed by the ear 34 projecting from arm 20 or an inner surface of the arm itself and in contact with the body of holder 12 so as to prevent forward pivotal movement of the container. A lower rearwardly-facing surface portion of the arm 20 in contact with a surface of the holder 12 is adapted to fix the arm and attached container 26 against rearward pivotal movement at a given position. The two contacting surface portions of the arm and holder, respectively, constitute limit-stop means substantially preventing forward or rearward pivotal movement of the arm and attached container. As above intimated, the spacer element 24 substantially fixes its lateral position. A firm position and symmetrical aligned appearance of the unit as well as a fixed operational location of the container aperture for individual removal of the wetted sheets is thus attained. Firmness of the container position may be enhanced by the provision of additional means such as the inclusion of pressure-sensitive adhesive areas or holding means described hereinafter, it being realized that a minimum of components is conducive to inexpensiveness.

Figure 2:
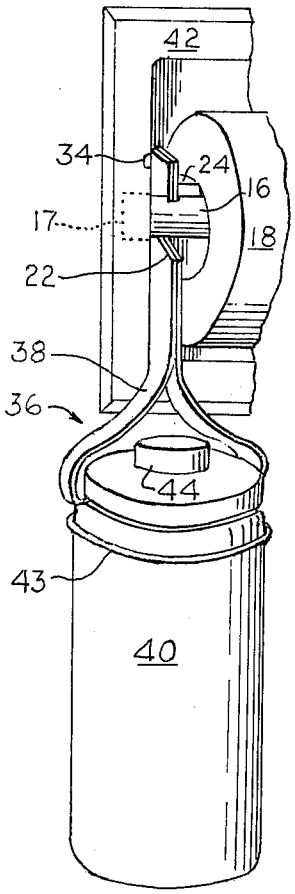
FIG. 2 is a diagrammatic perspective view of the device wherein a modification of the arm and container is illustrated.

In FIG. 2 there is shown another form 36 of the prewetted sheet supply and positioning device of the invention including a slightly modified arm member 38 gripping at two places a container 40 of the sheets to maintain its fixed level position in operational alignment with the roll-holder 42 and against any other undesired movement. The holder 42 is, optionally, of a so-called flush type, bores 17 being formed in supporting side portions rather than in forwardly-projecting posts as elsewhere shown. Suspension of arm member 38 is by the diagonally slotted portion 22, similar to that of FIG. 1. The arm member may be unitary with the container; pivotally attached thereto whereby it can be folded against the container when released from the spindle for separate transport or compact packaging purposes; or releasably fastened to the container as by snap-, turn-botton or other simple fastener means or a circular holding frame of the type illustrated in FIG. 5 adapted to engage a flange 43. Prewetted sheet material is withdrawn through an aperture adapted to provide individual sheets from a continuous length of semi-perforated material when a leading portion is manually drawn upon. The cap 44 is removable for access to the leader. Additional holding or position-fixing means of the type mentioned hereinafter may be combined with the device of FIG. 2 in areas thereof whose adaptability will be apparent.

A fragmentary side view of the arm member (20 or 38) illustrated in FIG. 3 further shows the slotted arm portion 22 and the lateral spacer means 24 employed in FIGS. 1 and 2.

Figure 4:
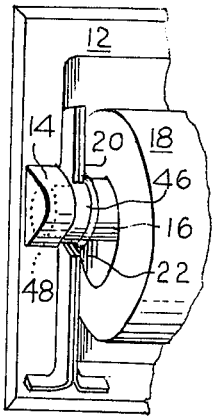
FIG. 4 is a fragmentary perspective view of a modification of the device of FIG. 1 which includes a socket element for reception of one end of the spindle and for bearing on its outer surface the slotted means of the arm member.
Figure 6:
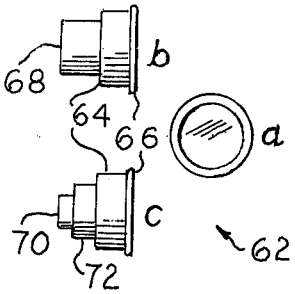
FIG. 6 is an elevation view of two types (b and c) of integral socket-stud components of the invention.

In FIG. 4 there is illustrated the addition of a cup-like socket component 46 shown more completely in the examples of FIG. 6. The socket component is unitary with a stud 48 which is inserted in and in fixed engagement with the bore in post 14. The slotted portion of the arm member 20 bears upon the surface of socket component 46 rather than upon spindle 16. The end of the spindle is positioned in the socket component. Thus the spindle can be retracted for replacement of an exhausted roll of toilet-tissue without disturbing the arm 20 bearing the contained supply of prewetted sheets.

Figure 5:
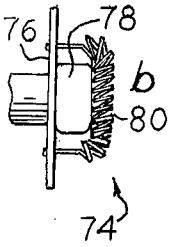
FIG. 5 is a fragmentary perspective view illustrating an integral construction of the arm member and socket element and with a stud component projecting from the latter and inserted in a bore of the roll-holder. Also shown attached to the lower end of the arm member is a frame releasably carrying a container of the pre-wetted sheet material.
Figure 5:
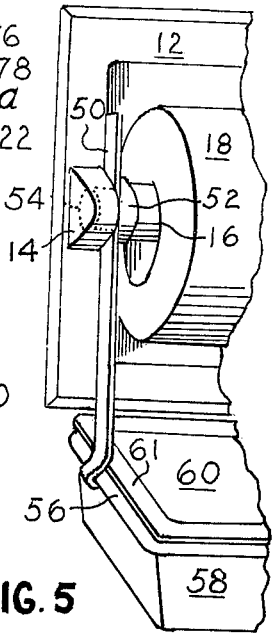

FIG. 5 illustrates a modification of structure wherein an arm member 50, a socket element 52 and a stud element 54 are to be assumed as integral and forming a single unit. The stud is firmly mounted in the bore of post 14 so as to hold the arm member 50 mixed at the position shown. In this example the lower extremity of the arm member is attached to a frame element 56. The element 56 is adapted to releasably mount a container 58 of prewetted sheets having a removable cover 60. An overhanging flange 61 of the container bears upon the frame element and, assuming a snug fit of container and frame, the sheets may be withdrawn from a suitable aperture underlying cover 60 upon removal of the latter. The container may, of course, be lifted out of the frame for replacement independently of the roll of toilet-tissue. The latter may be replaced by withdrawing the spindle from socket element 52 independently of arm member 50 and thus independently of the contained supply of prewetted sheets.

In FIG. 6 there are illustrated unitary socket-stud means 62, representative of the socket elements shown in FIGS. 4 and 5. The element **62*b* comprises a socket component 64 having a flange 66 and, unitary therewith, a stud or plug component 68. The element 62*c* comprises similar socket and flange components 64 and 66 and a modified stud component which includes portions 70 and 72 of different diameter which accomodate to toilet-dispensers in which the spindle-receiving bores differ in diameter. This is usually the case between metallic and ceramic dispensers. In the illustration one-half of the stud may be used to engage the bore in the appropriate instance. A further adaptation (not illustrated) contemplates a unitary stud of the smaller diameter and a sheath of the larger diameter adapted to be slipped over the smaller stud and anchored thereto by any means such as a key and slot, an adhesive, etc., whereby the unit is adapted to use with the bore of either diameter. The front view 62*a*** represents the interior of either socket *b* or *c*. The components may, appropriately, be composed of a plastic or a metal and have resilient or adhesive surfaces for providing firm engagement with the bore surfaces and, as in the example of FIG. 5, for fixing the position of the arm member 50. It is to be understood that where elsewhere arm members are shown as bearing upon the socket element or which may so bear if, as may be the case in every instance if desired a socket element is included, the contacting surfaces of arm member and socket element may be formed for mutually one another as by a fluted, toothed or other appropriate structure. Inclusion of the socket of course implies space between an end of the toilet-tissue roll and the bore for its inclusion which may always be the case.

Figure 7:
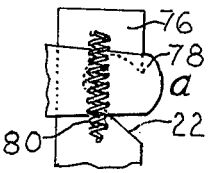
FIG. 7, *a* and *b*, illustrate different views of tensioning means for holding the arm member firmly against one side of a spindle-bearing post of the roll-holder. The spring-like element provides a fastening means which accomodates to posts of differing height or width dimensions.

FIG. 7, *a* and *b*, illustrates supplemental means for holding an arm member, such as arm member portion 76, firmly against a post 78 of a standard toilet-tissue dispenser. The arm member may for example, be of the types shown in FIGS. 1 through 5. The ends of an extension spring element 80 are fastened to the arm member 76 in somewhat widely spaced relation. The spring element 80 under tension is adapted to pass around and grip the post 78 while drawing the arm member firmly thereagainst. A particular advantage of this holding means is that it accomodates to posts which differ dimensionally in size and shape, which is the case relative to those of metallic and ceramic composition. As will be apparent, the structure may be modified whereby the spring element contacts upper and lower surfaces of the post also.

Figure 8:
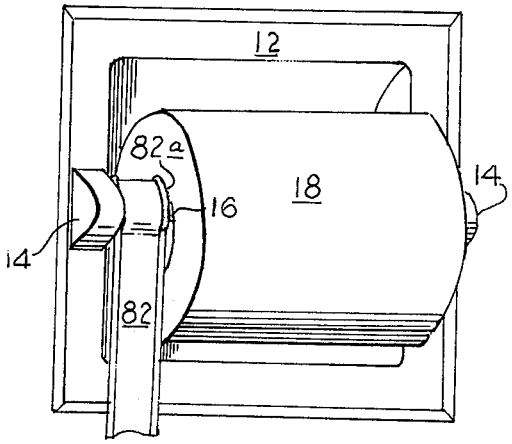
FIG. 8 is a diagrammatic perspective view of the conventional roll-holder showing a modification of the arm member and its attachment to the spindle.

FIG. 8 illustrates an arm member 82 having a broader bearing surface than those previously described for gripping the spindle 16, thereby presenting means for offsetting any tendency of the arm to lateral slippage longitudinally of the spindle. This type of arm member, shown further in FIG. 9*b*, is easy to mount, provides an enhanced firmness of a container of prewetted sheets (not shown) attached to its lower extremity and is of very simple inexpensive structure. The container may be of any type described or suggested herein.

Figure 9:
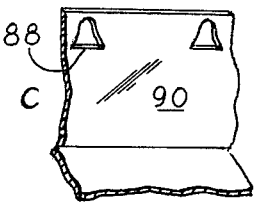
FIG. 9 is a fragmentary perspective view of the toilet-tissue roll-holder depicting, respectively, an arm member of the modified type of FIG. 8 attached to the spindle and a portion of a container with means for releasably attaching it to the arm member. A side view of a portion of the arm member is shown to illustrate the curved extremity which engages the spindle and optional snap-fastener means for additional support.

The arm member 84 of FIG. 9 may be basically similar to that of FIG. 8 and thus possess the aforesaid advantages of simplicity of structure, positional firmness and ease of installation or removal. By way of further example, the arm member 84, bearing upon the spindle 16, includes at its lower end a pair of laterally spaced pins 86 having enlarged heads which are adapted to insertion in the apertures 88 of the container portion 90 for releasably mounting the container and supply of prewetted sheets (not shown) releasably confined therein. The arm member is shown from the side at b. The arm member 84 is represented as including, as an optional element for additional positional firmness, a snap-fastener component 92 adapted to engage the component 94, the latter being fastened to the dispenser 12.

It is to be understood that the structure of FIGS. 8 and 9 may well include the socket-stud elements above described and shown in FIG. 6 whereby the arm members of FIGS. 8 and 9 would bear upon a socket component instead of directly upon the spindle and thus provide the flexibility of allowing the roll of toilet-tissue and the container of prewetted sheets to be replaced completely independently of one another. Supplemental positioning fasteners may also be supplied for use in a manner above described. Also the resilient holding means of FIG. 7 may be incorporated with the structures of FIGS. 8 or 9 by providing a vertical flange on that area of the arm member which is contiguous with the post, the surface of this flange being coplanar with the contiguous post surface. The extremities of the spring element 80 are fastened to this flange in the same manner as their attachment to the arm 76 of FIG. 7 and the resultant holding operation is identical to that described relative to the latter.

While the container has been shown as fixedly attached to an arm member it may be adjustably thus fastened where, for example, a leveling procedure might be of advantage to compensate for any tilting thereof due to a peculiarity of the roll-holder form. While a substantial rigidity is a preferred characteristic of the arm members described herein, it is conceivable that an arm member may have a degree of flexibility and still hold its attached container in a fixed aligned position if spaced auxiliary fastening means are employed in conjunction therewith and with the container per se. Means of the type above described would be generally suitable to such a purpose. The inclusion of two arm members, that is one attached adjacent to each post of the roll-holder with the container of prewetted sheets suspended for positioning therebetween is, of course, a feasible possibility. The simpler construction shown is thought to have an advantage at least of cost although the two-arm embodiment is considered to be within the scope of the present invention.

A specific structure of prewetted sheet is not described herein for the reason that latitude thereof is possible. Thus interleaved sheets or strips of separable sheets of proper tear resistance and known in the art are contemplated for use herewith. The container components are thought not to be limited to the function of carrying prewetted sheets although that is a principal object of the present case. Other materials such as medicaments or the like might have significant advantage at this location.

The constructions shown herein are adapted to either a throw-away or a more or less permanent usage. Thus, for example, the embodiments of FIGS. 1 and 2 and of FIG. 8, assuming a unitary structure of arm member and container, a moderately priced plastic composition, and a practicable manufacturing procedure could be discarded en toto when a container of prewetted sheets is exhausted and a new loaded unit installed. On the other hand, as in the examples of FIGS. 5 and 9, merely the exhausted container could be removed and replaced. Assuming improved structures of the type herein presented relative to the art, the more permanent constructions might have functional and appearance advantages and the replacement merely of new loaded container should, it is thought, present a price advantage. It will be understood that where the container per se is a separable entity it can substantially or completely duplicate a portable prewetted sheet-carrying product and can serve as such constituting a greatly expanded usage and economic advantage relative to manufacturing volume and cost. All of the parts described herein appear to be adapted to an injection moulding or other practicable manufacturing process.

It will be understood that the subject invention may be practiced or embodied in other ways without departing from the character or spirit thereof. The preferred embodiment described herein is to be regarded, therefore, as illustrative and not restrictive, the scope thereof being indicated by the appended claims and all variations which come within the meaning of the claims are intended to be embraced therein.

I claim:

1. A device for supplying and positioning auxiliary material adjacent to a standard toilet-tissue roll dispenser which dispenser comprises a principal body adapted to mounting on a bathroom wall and a plurality of roll holding means including a plurality of laterally spaced support portions integral with said body, each having a bore formed therein adapted to mount therebetween a retractable spindle for releasably carrying the roll of toilet-tissue as well as other means for supporting the device, the roll of toilet-tissue, in addition to being rotatable, being slidable in a direction longitudinally of the spindle by a given amount so that a given space may normally be provided in said direction longitudinally of the spindle between one end of the roll of toilet-tissue and core thereof and one of said spaced support portions, the device comprising:

a preferably substantially rigid arm member;

means forming an effective concavity in an upper portion of said arm member for connecting said upper portion thereof to a given one of said spindle and other supporting means to provide a generally vertical suspension of said arm member;

means providing a lateral space for positioning said upper arm portion between a support portion and said tissue coll means of a given thickness, at least partially encircling said spindle positioned adjacent to said arm member for fixing said arm member against lateral movement from said given position by occupying said lateral space; longitudinally of the spindle;

limit-stop means fixing said arm member against forward and rearward pivotal movement including upper and lower portions of the arm member adapted to contact given portions of said principal body;

a container having a predetermined located aperture releasably carrying a supply of said auxiliary material; and means connecting a lower portion of said arm member to said container, the aforesaid means fixing the arm member against movement, serving to provide a firm fixed mounting of the container and a consistently given position of said aperture for facilitating removal of the auxiliary material.

2. A device as defined in claim 1 wherein said container is unitary with said lower portion of the arm member whereby said container and arm member can be installed or removed as a unit and may be considered a disposable item.

3. A device as defined in claim 1 wherein said container is releasably attached to said lower portion of the arm member whereby said container when exhausted can be removed and a new container carrying said material installed.

4. A device as defined in claim 1 wherein said arm member is principally a flat elongated item and wherein said upper arm portion includes an angularly disposed slot formed inwardly of an edge thereof which is adapted to receive and bear upon said spindle to provide a given suspension of said arm member and to permit its attachment to or release from said spindle without dislodgement of the spindle or of a roll of toilet-tissue mounted thereon.

5. A device as defined in claim 1 wherein said arm member is principally a flat elongated item its upper portion being overturned for releasably engaging one of said spindle and socket component said upper portion at least substantially constituting said space occupying means.

6. A device as defined in claim 1 wherein spacer means is provided to occupy the space between an end of the toilet-tissue roll and the suspended arm member.

7. A device as defined in claim 1 wherein said lower portion of the arm member is attached to a frame-like element and wherein said container is adapted to be manually inserted in or removed from said frame-like element.

8. A device as defined in claim 1 wherein supplemental fastener means is mounted on at least one of said arm member and container and adapted to engage complementary fastener means mounted on the toilet-tissue dispenser.

9. A device as defined in claim 8 wherein said fastener means is a firmly holding type of snap-fastener.

10. A device as defined in claim 1 wherein said container is adapted to constitute a portable unit when of a type separable from said arm member and when thus separated and carrying a supply of said material.

11. A device as defined in claim 1 wherein said upper portion of the arm member includes an extension spring element the ends of which are attached thereto, the spring element being adapted to substantially pass around one of the posts supporting the spindle to draw the arm member firmly thereagainst.

12. A device for supplying and positioning auxiliary material adjacent to a standard toilet-tissue roll dispenser which dispenser comprises a plurality of roll holding means including a pair of laterally spaced supports each having a bore formed therein adapted to mount therebetween a retractable spindle for releasably carrying the roll of toilet-tissue as well as other means for supporting the device, the roll of toilet-tissue, in addition to being rotatable, being slidable in a direction longitudinally of the spindle by a given amount so that a given space may be provided in said direction between an end of the roll of toilet tissue and one of said spaced supports, the device comprising:

a preferably substantially rigid arm member;

means releasably connecting an upper portion of said arm member to said other supporting means to provide a substantially vertical suspension of said arm member in the form of a stud component projecting from said upper portion of said arm member in a first direction inserted in one of said bores, and coaxially therewith and projecting therefrom in a second and opposite direction a cup-like socket component for accepting one end of said spindle, thus for the purpose taking the place of the bore itself;

means providing a given lateral position of said upper arm portion within said given space;

means fixing said arm member against lateral movement from said given position;

means fixing said arm member against pivotal movement;

a container releasably carrying a supply of said auxiliary material; and means connecting a lower portion of said arm member to said container.

13. A device as defined in claim 12 wherein said stud component is anchored against movement in said bore.

14. A device as defined in claim 12 wherein said upper arm portion and said stud and socket components are formed integrally to form a single unit.

15. A device for supplying and positioning auxiliary material adjacent to a standard toilet-tissue roll dispenser which dispenser comprises a plurality of roll holding means including a pair of laterally spaced supports each having a bore formed therein adapted to mount therebetween a retractable spindle for releasably carrying the roll of toilet-tissue as well as other means for supporting the device, the roll of toilet-tissue in addition to being rotatable being slidable in a direction longitudinally of the spindle by a given amount so that a given space may be provided in said direction between one end of the roll and one of said spaced supports, the device comprising:

a preferably substantially rigid arm member;

means releasably connecting an upper portion of said arm member to said other supporting means to provide a substantially vertical suspension of said arm member comprising integral combined stud and socket components in coaxial relation, the stud component being inserted in one of the bores and the socket component receiving one end of the spindle, a recessed surface area of said upper arm portion bearing upon an outer surface of said socket component whereby the arm member is suspended from the socket component and the spindle can be engaged or disengaged entirely independently of the arm member and supply of auxiliary material, means providing a given lateral position of said upper arm portion within said given space;

means fixing said arm member against lateral movement from said given position;

means fixing said arm member against pivotal movement;

a container releasably carrying a supply of said auxiliary material; and means connecting a lower portion of said arm member to said container.

16. A device as defined in claim 15 wherein said stud component comprises a plurality of different sized portions adapted for insertion in bores of different diameters.

17. A device as defined in claim 15 wherein said surfaces of the arm member and socket component are so formed for mutual engagement that the arm member is fixed against movement.

* * * * *